US011342647B2

(12) United States Patent
Heston et al.

(10) Patent No.: US 11,342,647 B2
(45) Date of Patent: May 24, 2022

(54) FREE-FORM DUAL DUAL-CONDUCTOR INTEGRATED RADIO FREQUENCY MEDIA

(71) Applicant: RAYTHEON COMPANY, Waltham, MA (US)

(72) Inventors: David D. Heston, Dallas, TX (US); Mikel J. White, Murphy, TX (US); Michael G. Hawkins, Plano, TX (US)

(73) Assignee: RAYTHEON COMPANY, Waltham, MA (US)

( * ) Notice: Subject to any disclaimer, the term of this patent is extended or adjusted under 35 U.S.C. 154(b) by 64 days.

(21) Appl. No.: 16/695,695

(22) Filed: Nov. 26, 2019

(65) Prior Publication Data

US 2021/0159578 A1 May 27, 2021

(51) Int. Cl.

| | |
|---|---|
| ***H01P 3/08*** | (2006.01) |
| ***H01P 1/203*** | (2006.01) |
| ***H01P 11/00*** | (2006.01) |

(52) U.S. Cl.

CPC ..... *H01P 3/081* (2013.01); *H01P 1/203* (2013.01); *H01P 1/20345* (2013.01); *H01P 11/003* (2013.01)

(58) Field of Classification Search

CPC ..... H01P 1/203; H01P 1/20345; H01P 3/081; H03H 2001/0085

USPC ..... 333/185

See application file for complete search history.

(56) References Cited

U.S. PATENT DOCUMENTS

| | | | | |
|---|---|---|---|---|
| 5,382,927 | A * | 1/1995 | Okamura | H01P 1/20381 333/175 |
| 5,745,017 | A | 4/1998 | Ralph | |
| 6,150,897 | A | 11/2000 | Nishikawa et al. | |
| 6,348,844 | B1 | 2/2002 | Albinsson et al. | |
| 8,212,580 | B2 | 7/2012 | Izadian | |
| 9,748,663 | B2 | 8/2017 | Wong | |
| 2004/0080455 | A1 | 4/2004 | Lee | |

OTHER PUBLICATIONS

International Search Report and Written Opinion for International Application No. PCT/US2020/050153; Application Filing Date Sep. 10, 2020; dated Dec. 22, 2020 (15 pages).

* cited by examiner

*Primary Examiner* — Rakesh B Patel
(74) *Attorney, Agent, or Firm* — Cantor Colburn LLP

(57) ABSTRACT

A free-from radio frequency (RF) media includes a substrate having a first dielectric layer formed thereon and a second dielectric layer on an upper surface of the first dielectric layer. A first conductive layer is formed on an upper surface of the first dielectric layer and has a first overall profile. A second conductive layer having a second overall profile is formed on an upper surface of the second dielectric layer such that the second dielectric layer is interposed between the first and second conductive layers. The first overall profile of the first conductive layer is different from the second overall profile of the second conductive layer.

14 Claims, 3 Drawing Sheets

FREE-FORM DUAL DUAL-CONDUCTOR INTEGRATED RADIO FREQUENCY MEDIA

BACKGROUND

The present invention relates generally to radio frequency (RF) media, and more specifically, to a RF transmission circuit and methods of fabricating the same.

Radio-frequency (RF) engineering and microwave transmission applications typically implement various RF transmission media such as, for example, transmission lines, waveguides, and/or antennas that produce or utilize signals within the radio band spectrum. RF transmission lines include, for example, co-axial cables and planar transmission lines (typically referred to as planar lines).

One type of balanced transmission line utilized in conventional RF applications is referred to as a twin-lead transmission line, sometimes simply referred to as a "twin-lead". A twin-lead transmission line consists of a pair of conductors held apart by a continuous insulator. The impedance of a twin-lead transmission line is a function of: (A) the size (diameter) of the two conductors; (B) the spacing between the two conductor; and (C) the dielectric constant of the dielectric material between the two conductors. An applied signal twin-lead results in an electric field between the two conductors that emanates from one conductor and terminates on the other conductor.

One type of planar transmission line is referred to as a microstrip transmission line, also referred to simply as a "microstrip". A microstrip employs a dielectric layer interposed between a thin flat conductor and a ground plane. The thin flat conductor (sometimes referred to as the upper trace or top trace) is formed parallel to the ground plane, and is configured to receive an applied signal. The impedance of microstrip is a function of: (A) the size (width) of the top conductor; (B) the spacing (height) above the bottom conductor; and (C) the dielectric constant of the dielectric material between the two conductors.

SUMMARY

According to a non-limiting embodiment, a free-from radio frequency (RF) media comprises a substrate including a first dielectric layer formed thereon and a second dielectric layer on an upper surface of the first dielectric layer. A first conductive layer is formed on an upper surface of the first dielectric layer and has a first overall profile. A second conductive layer having a second overall profile is formed on an upper surface of the second dielectric layer such that the second dielectric layer is interposed between the first and second conductive layers. The first overall profile of the first conductive layer is different from the second overall profile of the second conductive layer.

According to another non-limiting embodiment, a method of fabricating a free-form radio frequency (RF) media comprises forming a bottom conductive layer having first overall profile on an upper surface of a bottom dielectric layer, and forming a top dielectric layer on an upper surface of the bottom dielectric layer such that the top dielectric layer covers the bottom conductive layer. The method further comprises forming a top conductive layer having a second overall profile on an upper surface of the top dielectric layer. The first and second overall profiles are formed independently of one another.

Additional technical features and benefits are realized through the techniques of the present invention. Embodiments and aspects of the invention are described in detail herein and are considered a part of the claimed subject matter. For a better understanding, refer to the detailed description and to the drawings.

BRIEF DESCRIPTION OF THE SEVERAL VIEWS OF THE DRAWINGS

The specifics of the exclusive rights described herein are particularly pointed out and distinctly claimed in the claims at the conclusion of the specification. The foregoing and other features and advantages of the embodiments of the invention are apparent from the following detailed description taken in conjunction with the accompanying drawings in which:

Figure 1:
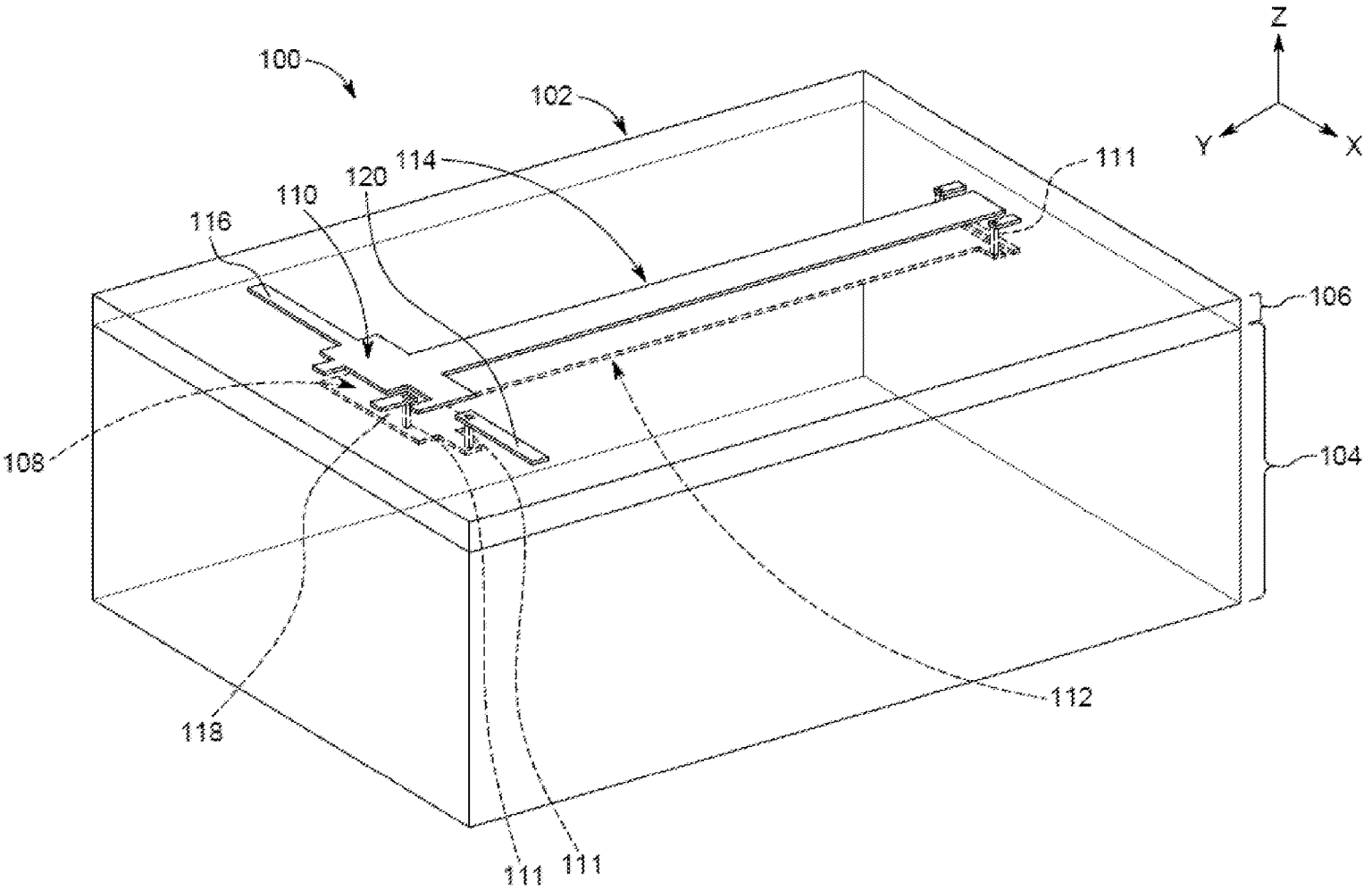
FIG. 1 is a perspective view of a free-form RF circuit according to a non-limiting embodiment.

The diagrams depicted herein are illustrative. There can be many variations to the diagram or the operations described therein without departing from the spirit of the invention. For instance, the actions may be performed in a differing order or actions may be added, deleted or modified.

DETAILED DESCRIPTION

Various embodiments of the invention are described herein with reference to the related drawings. Alternative embodiments of the invention can be devised without departing from the scope of this invention. Various connections and positional relationships (e.g., over, below, adjacent, etc.) are set forth between elements in the following description and in the drawings. These connections or positional relationships, unless otherwise specified, can be direct or indirect, and the present invention is not intended to be limited in this respect. Moreover, the various tasks and process operations described herein can be incorporated into a more comprehensive procedure or process having additional steps or functionality not described in detail herein, or one or more tasks or operations may be optional without departing from the scope of the invention.

The following definitions and abbreviations are to be used for the interpretation of the claims and the specification. As used herein, the terms "comprises," "comprising," "includes," "including," "has," "having," "contains," or "containing," or another variation thereof, are intended to cover a non-exclusive inclusion. For example, a composition, mixture, process, method, article, or apparatus that comprises a list of elements is not necessarily limited to only those elements but can include other elements not expressly listed or inherent to such composition, mixture, process, method, article, or apparatus.

Additionally, the terms "at least one" and "one or more" may be understood to include a number greater than or equal to one (e.g., one, two, three, four, etc.). The term "a plurality" may be understood to include a number greater than or equal to two (e.g., two, three, four, five, etc.). The terms "about," "substantially," or "approximately," or variations thereof, are intended to include a degree of error associated with measurement of the particular quantity based upon the equipment available.

For the sake of brevity, conventional techniques related to making and using aspects of the invention may or may not be described in detail herein. In particular, various aspects of computing systems to implement the various technical features described herein may be well known. Accordingly, in the interest of brevity, some conventional implementation details are only mentioned briefly herein or are omitted entirely without providing the well-known system or process details.

Turning now to an overview of technologies that are relevant to the inventive teachings described herein, traditional planar transmission lines such as twin-lead transmission lines and microstrips have proven to be acceptable designs when transmitting RF signals for low-loss circuits. Twin-lead transmission lines, however, are susceptible to damage and are vulnerable to noise and interference. In addition, the design of twin-leads prevents integrating with the line itself additional RF and microwave components such as, for example, couplers, filters, capacitors, power dividers, active devices such as FETs, etc.

Microstrips can be fabricated from a substrate using printed circuit board technology, which allows additional microwave components to be formed from the microstrip itself. Accordingly, the additional microwave components can be directly integrated with the entire device existing as a pattern of metallization on the substrate. Similar to twin-lead transmission lines, microstrips are also capable of transmitting RF signals for low-loss circuits. However, achieving balanced circuit connections between electrical components (e.g., transistors, FETs, etc.) using microstrips has proven extremely difficult. For instance, a microstrip utilizes a thin top strip formed above a bottom ground plane that consumes the entire bottom surface of the dielectric. This ground plane is sometimes referred to as an "infinite ground plane. The substantial size difference between the thin top microstrip and the opposing infinite ground plane will inherently create a circuit imbalance. Consequently, microstrips can be undesirable in RF circuit designs that are intentionally designed to employ balanced circuits.

Various non-limiting embodiments described herein provide a free-form dual-conductor integrated RF transmission media (referred to herein as a free-form RF circuit) capable of achieving high-impedance signal transmission in either shunt or series configurations, while being highly resistive to noise or interference. When forming a free-form RF circuit according to one or more non-limiting embodiments described herein, a substrate is provided that includes top and/or bottom conductors interposed between one or more dielectric layers. The top and/or bottom conductor may further include one or more conductive traces. Unlike traditional planar-type transmission lines, however, the free-form RF circuit described herein allows for varying the dimensions of one or both of the top and bottom conductors. The ability to vary the dimensions of the top and bottom conductors and/or traces independently from one another is referred to "free-form" or a free-form arrangement, which allows for provided the free-form RF transmission media described herein. In further distinction from traditional planar transmission lines, the top and/or bottom conductor can include one or more traces that exclude a corresponding opposing mating trace (sometimes referred to as a reference trace) which would typically be provided on the opposing conductor. In this manner, matching circuit networks can be achieved by varying the length, width and/or pattern of the top and bottom conductors relative to each other. Accordingly, the free-form RF transmission media described herein can be designed to achieve both balanced RF circuits and unbalanced RF circuits according to an intended RF circuit design.

With reference now to FIG. 1, a free-form RF circuit 100 is illustrated according to a non-limiting embodiment. The free-form RF circuit 100 includes a substrate 102 extending along a first axis (e.g., X-axis to define a length), a second axis (e.g., Y-axis) to define a width, and a third axis (e.g., Z-axis) to define a height (i.e., thickness). The substrate 102 includes a plurality of dielectric layers. For example, the substrate 102 includes a first dielectric layer 104 and a second dielectric layer 106 on an upper surface of the first dielectric layer 106. In one or more embodiments, the first dielectric layer is a bottom dielectric layer 104 while the second dielectric layer is a top dielectric layer 106. It should be appreciated, however, that the positions of the first and second dielectric layers 104 and 106 may be reversed. Although two dielectric layers 104 and 106 are discussed going forward, it should be appreciated that additional dielectric layers may be included in the substrate 102 without departing from the scope of the invention.

In some non-limiting embodiments, the bottom and top dielectric layers 104 and 106 can be formed of the same dielectric material. In other non-limiting embodiments, however, the bottom dielectric layer 104 can be formed from a first dielectric material, while the top dielectric layer 106 is formed from a different dielectric material. For example, the bottom dielectric material can include various insulative materials such as, for example, silicon carbide (SiC), diamond, while the top dielectric material can include other dielectric materials such as, for example, benzocyclobutene (BCB), gallium arsenide (GaAs), or gallium nitride (GaN). Various deposition process can be performed to deposit the top dielectric layer 106 including, but not limited to, chemical vapor deposition (CVD), atomic layer deposition (ALD), and spin-on coating.

The thickness of the bottom dielectric layer 104 is greater than the thickness of the top dielectric layer 106. In one example, the bottom dielectric layer 104 can be formed of SiC and can have a thickness ranging, for example, from about 20 mils to about 25 mils, or about 0.5 millimeters (mm), while the top dielectric layer 106 can be formed of BCB and can have a thickness ranging, for example, from about 25 micrometers (μm) to about 35 μm. In another non-limiting embodiment, the bottom dielectric layer 104 can be formed of diamond and can have a thickness ranging, for example, from about 20 mils to about 25 mils, or about 0.5 millimeters (mm), while the top dielectric layer 106 can be formed of GaN and can have a thickness ranging, for example, from about 3 mils to about 5 mils, or about 0.1 mm.

The free-from radio frequency (RF) circuit 100 further includes at least one pair of opposing conductive layers having different profiles with respect to one another. In one example illustrated in FIG. 1 the opposing conductive layers include a first conductive layer 108 and a second conductive layer 110. In one or more embodiments, the first conductive layer is a bottom conductive layer 108 while the second conductive layer is a top conductive layer 110. It should be appreciated, however, that the positions of the first and second conductive layers 108 and 110 may be reversed. The bottom conductive layer 108 is formed on an upper surface of the bottom dielectric layer 104 and is covered by the top dielectric layer 106. The top conductive layer 110 is formed on an upper surface of the top dielectric layer 106. Accordingly, the top dielectric layer 106 electrically isolates the bottom conductive layer 108 from the top conductive layer 110. In addition, the thicker bottom dielectric layer 104 reduces extraneous interference and noise exerted from other conductors and/or electrical components, including an established ground conductor/trace, thereby strengthening electrical coupling between the bottom conductive layer 108 and the top conductive layer 110.

Electrical connections between one or more portions or segments of the top and bottom conductive layers 108 and 110 can be established by forming vias 111 through selected locations of the top dielectric 106. For example, a first electrical connection between a first pair of opposing traces can be established using a first via, while a different second electrical connection between a different pair of opposing traces can be established using a different via.

Unlike traditional planar-type transmission lines, the top and bottom conductive layers 108 and 110 may have varying dimensions with respect to one another. The ability to vary the dimensions of the top and bottom conductive layers 108 and 110 independently from one another is referred to as "free-form" or a free-form arrangement, which allows for providing the free-form RF circuit 100.

In one or more non-limiting embodiments, the bottom conductive layer 108 has at least one bottom mating portion 112 and the top conductive layer 110 has at least one top mating portion 114. The profile and dimensions of the bottom mating portion match 112 are substantial identical to the profile and dimensions of the top mating portion 114. The bottom conductive layer 108 and/or the top conductive layer 110 may also have one or more individual portions, which exclude a mating portion. As shown in FIG. 1, for example, the top conductive layer 110 has an individual portion 116. However, the profile and dimensions of the individual portion 116 are mismatched or different with respect to the profile and dimensions of the underlying bottom conductive layer 108. In this manner, the impedance of the free-form RF circuit 100 can be selectively and precisely tuned. For example, omitting a mating conductor increases the impedance of the remaining conductor or remaining portion of the conductor compared to regions of the free-form RF circuit that includes opposing mating conductors (i.e., a bottom conductor covered by a top mating conductor).

Figure 2:
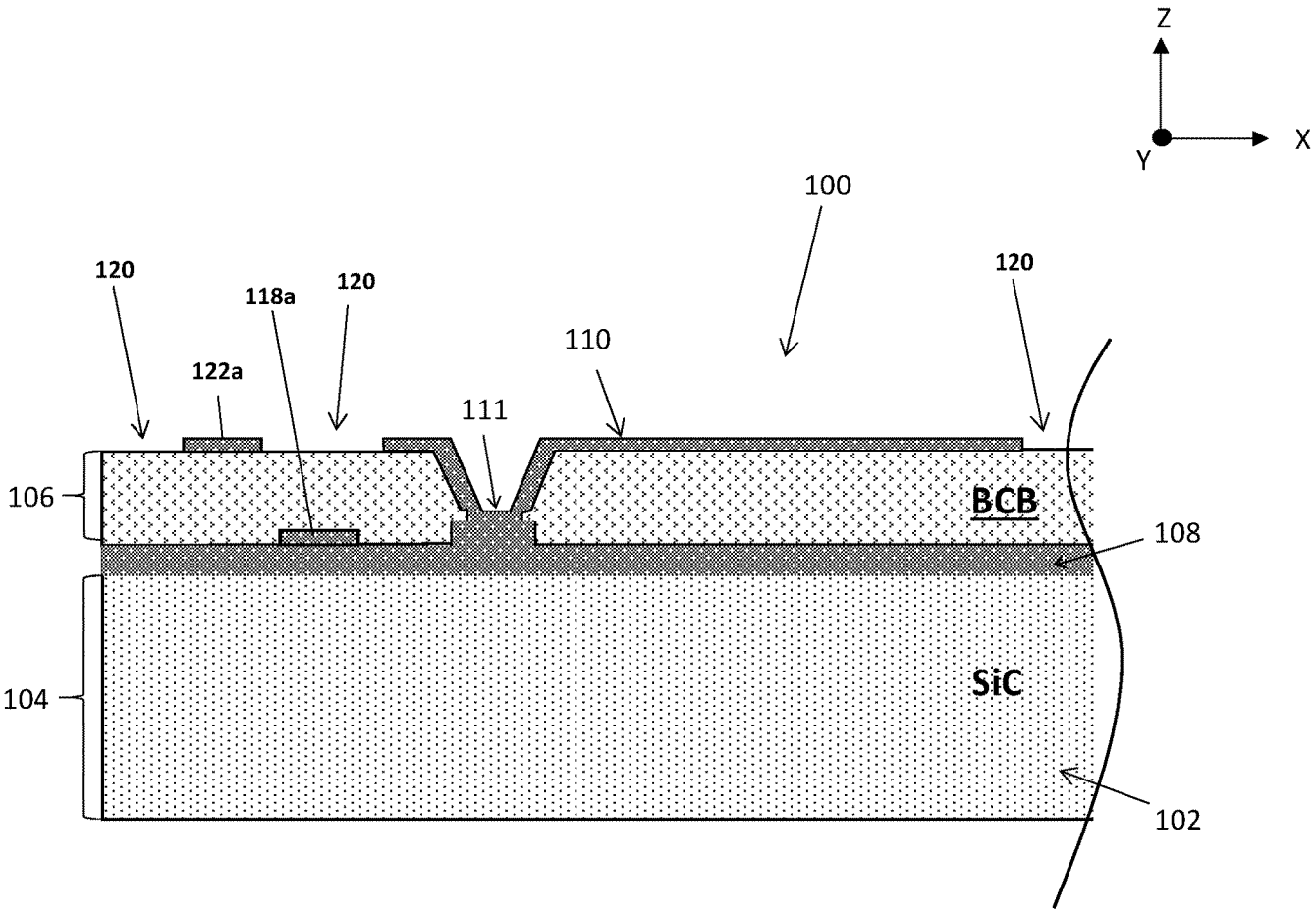
FIG. 2 is a cross-sectional view of a free-form RF circuit according to a non-limiting embodiment.

Still referring to FIGS. 1 and 2, the bottom conductive layer 108 and/or the top conductive layer 110 can further include one or more independent conductive traces 118 and 120. As shown in FIG. 1, for example, one or more conductive traces (e.g., trace 116) can have one end that is electrically coupled to a respective conductive layer (e.g., the top conductive layer 110) and an opposing free end that is disconnected from the conductive layer, while other conductive traces (e.g., trace 118) have opposing free ends that are each disconnected from the respective conductive layer (e.g., the top conductive layer 110). The capability of forming bottom and top conductive traces having different profiles and dimensions with respect to one another further allows for selectively tuning the impedance of the free-form RF circuit 100.

In one or more embodiments, the independent traces 116, 118, and 120 can be formed by subsequently patterning the top and bottom conductive layers 108 and 110, respectively. In other embodiments, the independent traces 116, 118, and 120 can be individually formed on their respective dielectric layers 104 and 106 using, for example, an additive manufacturing process. In any case, one or more of the independent traces 116, 118, and 120 or a portion thereof exclude a corresponding opposing mating trace, which would typically be provided using the opposing conductor when fabricating traditional planar-type RF circuits such as microstrips.

Referring to FIGS. 1 and 2, for example, the bottom conductive layer 108 can be patterned to form independent bottom trace 118 on the upper surface of the bottom dielectric layer 104. However, the top conductive layer 110 can be patterned so that a region above the independent bottom trace 118 is not covered by the top conductive layer 110. In other words, the top conductive layer 110 does not extend over the bottom trace 118. The top conductive layer 110 can also be patterned to form voids 120 (see FIG. 2) so that a portion of the bottom trace 11 is not covered by the top conductive layer 110. (i.e., the top conductive layer 110 does not extend over a portion of bottom trace 118). In either case, a portion of the bottom conductive layer 108 or the entire bottom trace 118 exclude an opposing matting trace (e.g., top-layer trace). Similarly, the top conductive layer 110 can be patterned to form independent top traces 116 and 120 on the upper surface of the top dielectric layer 106. The top conductive layer 110, however, can be patterned so that the top traces 116 and 120 are formed at locations that exclude a portion of the bottom conductive layer 108 or bottom traces therebeneath. Accordingly, the top traces 116 and 120 exclude an opposing matting trace (e.g., bottom-layer trace).

Figure 3:
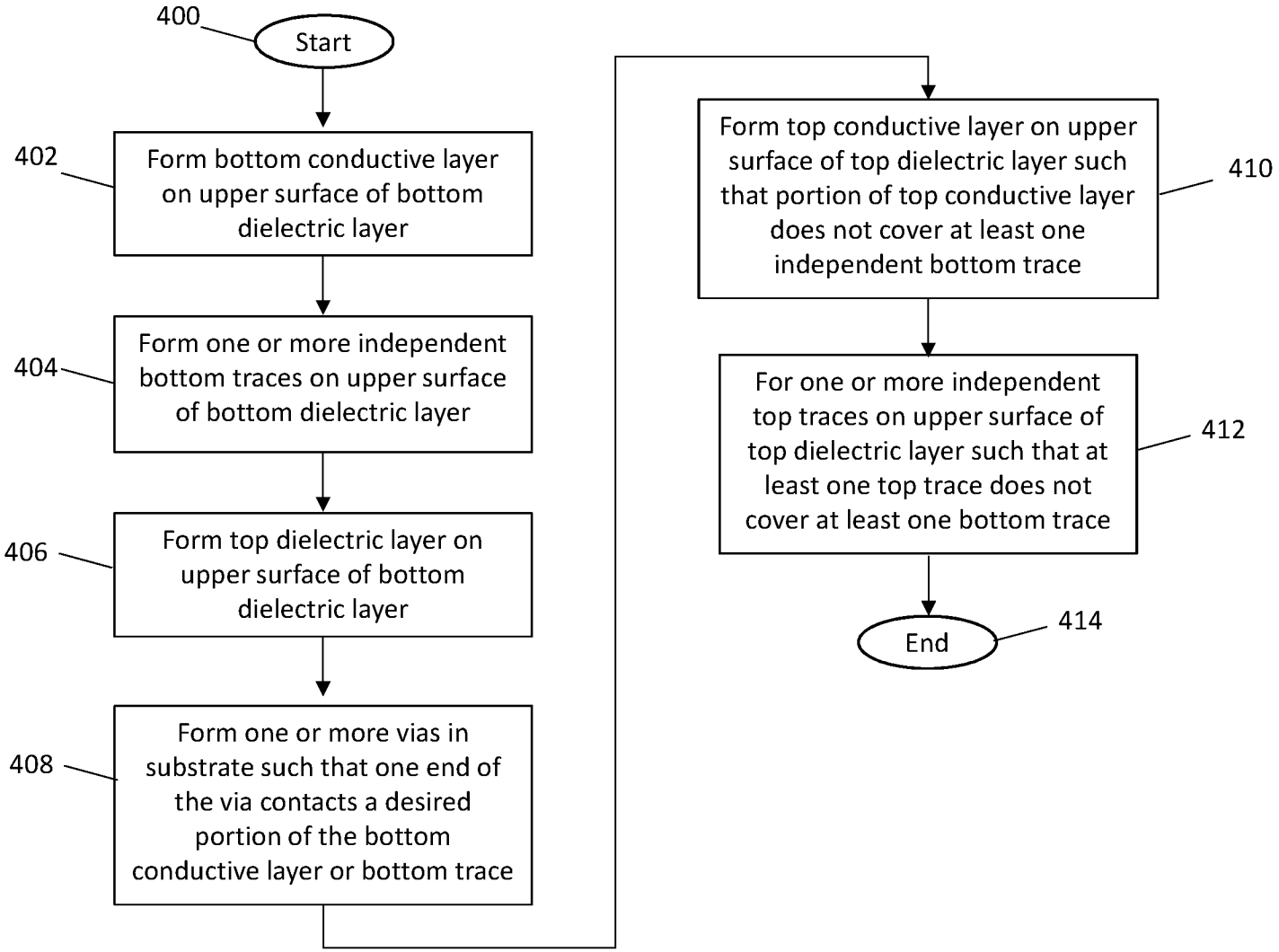
FIG. 3 is a flow diagram illustrating a method of fabricating a free-form RF circuit according to a non-limiting embodiment.

With reference now to FIG. 3, a flow diagram illustrates a method of fabricating a free-form RF circuit according to a non-limiting embodiment. The method begins at operation 400 and at operation 402 a substrate including a bottom dielectric layer having a first thickness is provided and a bottom conductive layer is formed on an upper surface of the bottom dielectric layer. At operation 404, one or more bottom traces are formed on upper surface of the bottom dielectric layer. The bottom traces are independent from the bottom conductive layer in that the bottom traces includes at least one free end that is disconnected from the bottom conductive layer. At operation 406, a top dielectric layer is formed on the upper surface of the bottom dielectric layer. The top dielectric layer has a second thickness that is less than the first thickness of the bottom dielectric layer. In this manner, the bottom dielectric layer can electrically isolate the electric fields present in the top dielectric layer from extraneous noise or influences exerted by other components or conductors, including the ground conductor. At operation 408, one or more vias are formed in through the first dielectric layer.

At operation 410, a top conductive layer is formed on the upper surface of the top dielectric layer. In one or more embodiments, a portion of the top conductive layer contacts an opposing end of a via formed in the top dielectric layer. In this manner, an electrically conductive path can be established between the top conductive layer and the bottom conductive layer. In one or more embodiments, a portion of the top conductive layer does not cover at least one underlying bottom trace formed on the bottom dielectric layer. At operation 412, one or more independent top traces are formed on the upper surface of the top dielectric layer. In one or more embodiments, a portion of a top trace contacts an opposing end of a via formed in the top dielectric layer. In this manner, an electrically conductive path can be established between a top trace and a bottom trace. In one or more embodiments, a portion of one of the top traces, or an entire top trace, does not cover or is not located above at least one of the bottom traces. After forming the independent top traces, the method ends at operation 414.

As described herein, various non-limiting embodiments provide a free-form dual-conductor integrated RF transmission media capable of achieving high-impedance signal transmission in either shunt or series configurations, while being highly resistive to noise or interference. Unlike traditional planar-type transmission media, however, the free-form RF circuit described herein allows for varying the dimensions of one or both of the top and bottom conductors independently from one another. In further distinction from traditional planar transmission lines, the top and/or bottom conductor can include one or more traces that exclude a corresponding opposing mating trace which would typically be provided on the opposing conductor. In this manner, matching circuit networks can be achieved by varying the length, width and/or pattern of the top and bottom conductors relative to each other. Accordingly, the free-form RF transmission media described herein can be designed to achieve both balanced RF circuits and unbalanced RF circuits according to an intended RF circuit design.

The description of the present invention has been presented for the purpose of illustration. This description is not intended to be exhaustive or to limit the invention to the forms disclosed. Many modifications and variations will be apparent to those of ordinary skill in the art without departing from the scope and spirit of the invention. The embodiments of the invention discussed herein were chosen and described in order to best explain the principles of the invention and the practical applications, and to enable others of ordinary skill in the art to understand the invention. While certain embodiments of the invention have been described, it will be understood that those skilled in the art, both now and in the future, may make various improvements and enhancements that fall within the scope of the claims that follow.

What is claimed is:

1. A free-from radio frequency (RF) media comprising:

a substrate including a first dielectric layer and a second dielectric layer on an upper surface of the first dielectric layer;

a first conductive layer having a first overall profile formed on an upper surface of the first dielectric layer, the first conductive layer including a bottom mating portion having a first bottom profile and a bottom individual portion having a second bottom profile;

a second conductive layer having a second overall profile formed on an upper surface of the second dielectric layer such that the second dielectric layer is interposed between the first and second conductive layers, the second conductive layer including a top mating portion having a first top profile and a top individual portion having a second top profile that matches the first bottom profile, wherein the first overall profile of the first conductive layer is different from the second overall profile of the second conductive layer, and wherein the first bottom profile matches as the first top profile, and the second bottom profile is mismatched with respect to the second top profile.

2. The free-form RF media of claim 1, wherein the first dielectric layer comprises a first dielectric material and the second dielectric layer comprises a second dielectric material that is the same as the first dielectric material.

3. The free-form RF media of claim 1, wherein the first dielectric layer is formed from a first dielectric material and the second dielectric layer is formed from a second dielectric material different than the first dielectric material.

4. The free-form RF media of claim 1, further comprising one or both of a bottom conductive trace having a bottom trace profile on an upper surface of the first dielectric layer and a top conductive trace having a top trace profile on the upper surface of the second dielectric layer.

5. The free-form RF media of claim 4, wherein the bottom trace profile is different than the top trace profile.

6. The free-form RF media of claim 4, wherein a portion of the bottom conductive trace is not covered by one or both of the second conductive layer and the top conductive trace.

7. The free-form RF media of claim 4, wherein a portion of the top conductive trace does not cover one or both of the first conductive layer and the bottom conductive trace.

8. The free-form RF media of claim 1, wherein the first dielectric layer has a first thickness and the second dielectric layer has a second thickness greater than the first thickness.

9. A method of fabricating a free-form radio frequency (RF) media, the method comprising:

forming a bottom conductive layer having first overall profile on an upper surface of a bottom dielectric layer, the bottom conductive layer including a bottom mating portion having a first bottom profile and a bottom individual portion having a second bottom profile;

forming a top dielectric layer on an upper surface of the bottom dielectric layer such that the top dielectric layer covers the bottom conductive layer, the top conductive layer to include a top mating portion having a first top profile and a top individual portion having a second top profile that matches the bottom mating profile; and forming a top conductive layer having a second overall profile on an upper surface of the top dielectric layer, wherein the first and second overall profiles are formed independently of one another, and wherein the first bottom profile is the same as the first top profile, and the second bottom profile is different from the second top profile.

10. The method of claim 9, wherein the second overall profile is different than the first overall profile of the bottom conductive layer.

11. The method of claim 10, further comprising forming one or both of a bottom conductive trace having a bottom trace profile on an upper surface of the bottom dielectric layer and a top conductive trace having a top trace profile on the upper surface of the top dielectric layer.

12. The method of claim 11, wherein the bottom trace profile is different than the top trace profile.

13. The method of claim 12 wherein a portion of the bottom conductive trace is not covered by one or both of the top conductive layer and the top conductive trace.

14. The method of claim 12, wherein a portion of the top conductive trace does not cover one or both of the bottom conductive layer and the bottom conductive trace.

* * * * *